United States Patent [19]

Cudini

[11] Patent Number: 4,776,196

[45] Date of Patent: Oct. 11, 1988

[54] PROCESS AND APPARATUS FOR FORMING FLANGED ENDS ON TUBULAR WORKPIECES

[75] Inventor: Ivano G. Cudini, Woodstock, Canada

[73] Assignee: TI Automotive Division of TI Canada Inc., London, Canada

[21] Appl. No.: 74,299

[22] Filed: Jul. 14, 1987

[51] Int. Cl.[4] ..... B21D 41/02

[52] U.S. Cl. ..... 72/316; 72/355; 72/392

[58] Field of Search ..... 72/316, 318, 355, 392, 72/393

[56] References Cited

U.S. PATENT DOCUMENTS

| | | | |
|---|---|---|---|
| 943,907 | 12/1909 | Austin . | |
| 1,119,416 | 12/1914 | Elger . | |
| 1,306,982 | 6/1919 | Walsh . | |
| 1,425,426 | 8/1922 | Vogt, Jr. . | |
| 1,932,584 | 10/1933 | Hansen . | |
| 2,292,054 | 8/1942 | Cleveland . | |
| 2,691,906 | 10/1954 | Finch . | |
| 3,298,218 | 1/1967 | Gollwitzer | 72/393 |
| 3,581,548 | 6/1971 | Lilygren . | |
| 3,759,203 | 9/1973 | Frankenberg . | |

*Primary Examiner*—Lowell A. Larson

*Attorney, Agent, or Firm*—Ridout & Maybee

[57] ABSTRACT

Apparatus for forming a flanged end on a tubular workpiece comprising a die having a throat therethrough connected at one end to an abutment surface of the die extending transversely on each side of the throat, a main frame connected to the die, a sub-frame mounted reciprocably on the frame longitudinally relative to the die, a pair of cheek pieces connected on the sub-frame and movable apart, and a wedge member mounted reciprocably on the sub-frame between the cheek pieces. The sub-frame is driven longitudinally relative to the main frame and the wedge member is driven longitudinally between the cheek pieces, whereby the cheek pieces can be separated by extending the wedge member longitudinally relative to the cheek pieces. The separated cheek pieces are then driven longitudinally towards the abutment surface.

8 Claims, 3 Drawing Sheets

PROCESS AND APPARATUS FOR FORMING FLANGED ENDS ON TUBULAR WORKPIECES

Figures 1A, 1B, 2A, 2B, 3A, 3B, 4A, 4B:
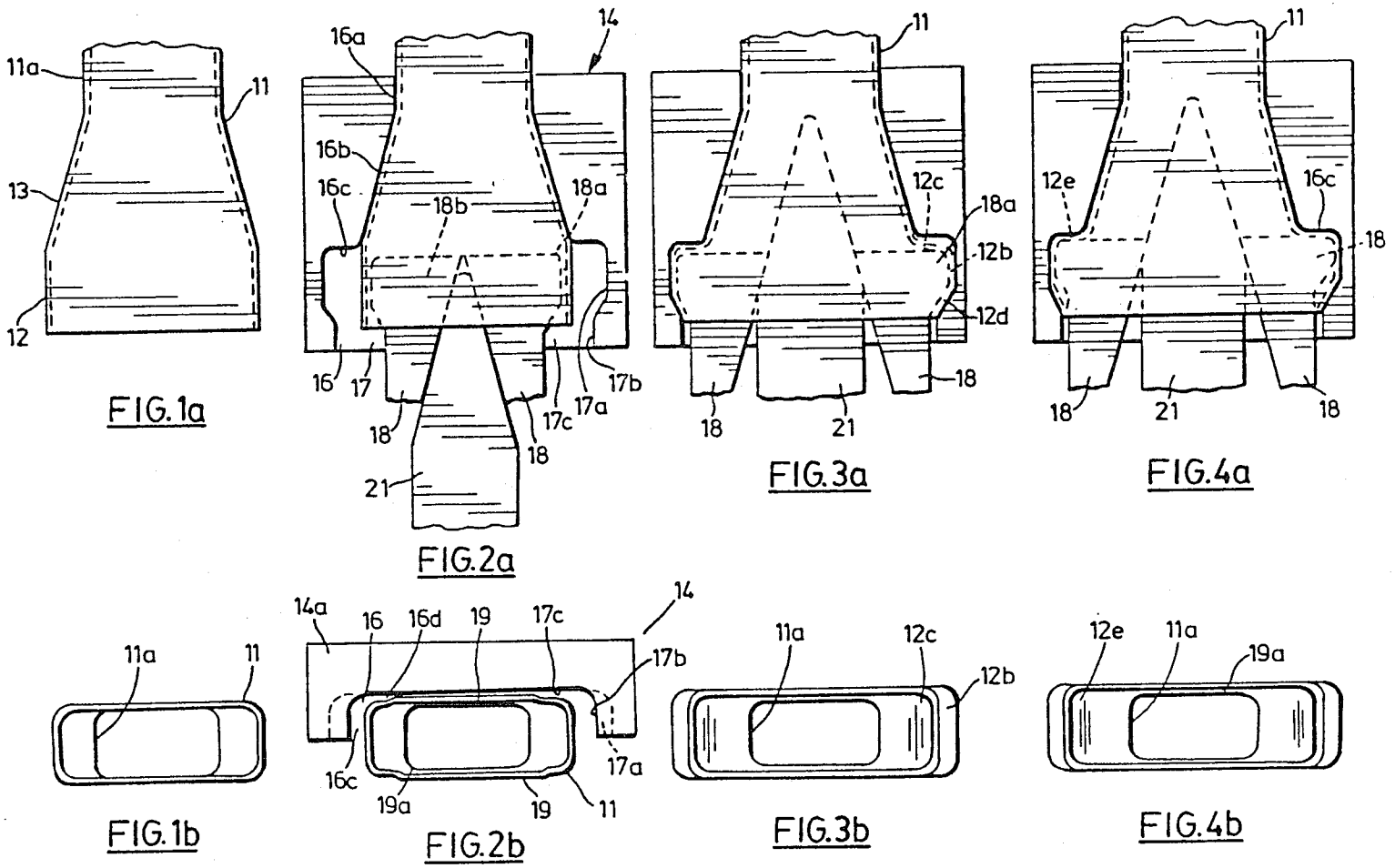
Figure 8A:
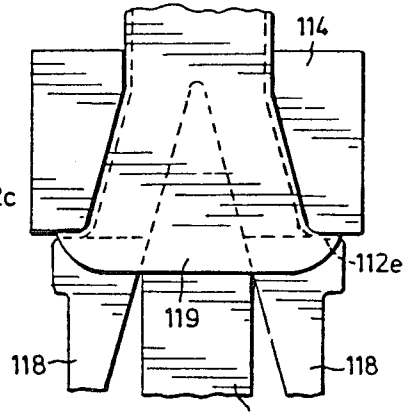
Figure 8B:
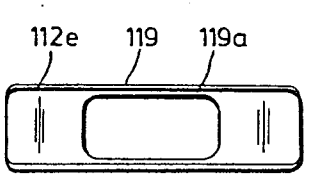
Figure 7A:
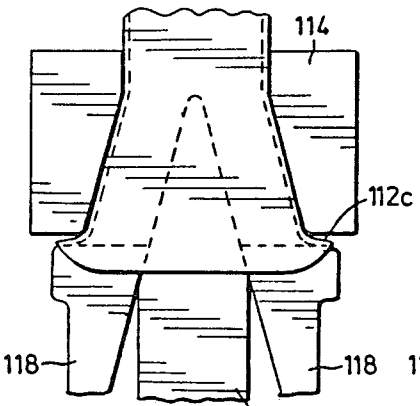
Figure 7B:
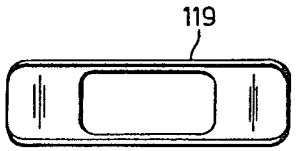
Figure 6A:
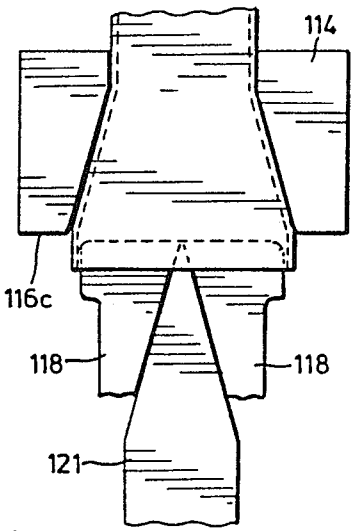
Figure 6B:
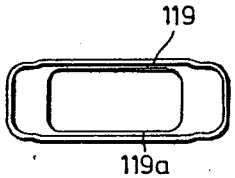
Figure 5A:
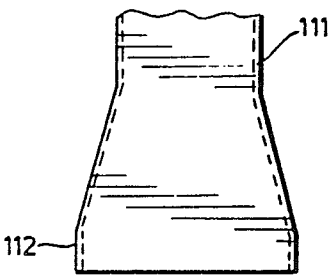
Figure 5B:
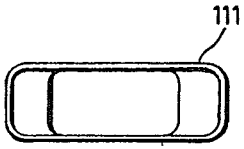

The invention relates to processes and apparatus for forming flanged ends on tubular workpieces.

It is known to form such flanged ends by ram forming the end of a workpiece while it is held within a vice contoured to the desired final outer form of the flanged end, using a ram which is contoured to the desired final inner form of the flanged end. This process, however, creates excessive frictional forces between the workpiece and the ram, and causes tearing of the material of the wall of the workpiece. The friction and tearing problems can be alleviated somewhat but not fully eliminated by the use of lubricants. Further, unless the wall of the tubular workpiece is sufficiently thick it is difficult or impossible to clamp the workpiece with the vice to create sufficient clamping force to withstand the axial thrust without collapsing the workpiece. The need for the tight clamping force can be alleviated to some extent if the tubular workpiece is more or less linear in form. In such case, a back stop can be applied to the end of the tube opposite the end to be ram formed, to withstand the axial thrust. This expedient is not possible, however, with tubes which are complexly or strongly curved.

Recently, it has become possible to form high strength, thin walled and relatively lightweight box section frame members from tubular workpieces, using the expansion techniques described in applicant's U.S. Pat. No. 4,567,743 issued to Feb. 4, 1986 and U.S. patent application Ser. Nos. 07/046,576 and 07/090,952 filed May 6, 1987 and Aug. 27, 1987, executed Apr. 29, 1987 and July 2, 1987 and entitled "Method of forming reinforced box-like frame members" and "Method of forming reinforced box-section frame members", respectively. Such techniques are outstandingly useful for the simplified manufacture of high strength light weight frame members, for example for the frames of cars, vans and other work vehicles. In many cases, however, it is desired to attach an end of a tubular frame member to a side wall of a cross member to form a frame structure, and in such cases it is highly advantageous to form a flanged end on the tubular frame member which can be utilised to make the cross connection. There is therefore a need for a satisfactory method of providing a flange on a tubular member which avoids or reduces the drawbacks noted above with the known methods. More especially, there is a need for a method which is capable of forming an accurately dimensioned and positioned flanged end on thin walled tubular frame members of standardized size and shape whereby flanged tubular members can be manufactured to a high degree of dimensional accuracy and repeatability.

The novel method of the present invention employs a die having a throat therethrough, within which the workpiece is positioned, and transversely expandable and collapsible mandrel which has a pair of cheek pieces with reaction means for separating them disposed between them. The mandrel, in collapsed condition, is introduced into one end of the workpiece and the cheek pieces expanded by operation of the reaction means between them. This expands the side wall of the workpiece transversely outwardly to overlie respective abutment surfaces which extend transversely on each side of the end of the throat passing through the die. The cheek pieces are then together driven longitudinally inwardly to coin a portion of each expanded side wall of the workpiece against a respective abutment surface, thereby forming the flanged portion. The mandrel may then be withdrawn from the workpiece and the workpiece withdrawn from the die.

Since the forces applied to the workpiece during the expansion step are laterally balanced and are directed substantially entirely transversely of the workpiece, there is no need to apply tight clamping pressure to the workpiece, and the frictional forces between the cheek pieces and the workpiece are relatively small, so that lubricants are not required. The axial thrust exerted in the coining step is absorbed by the transversely extending abutment surfaces of the die and there is little force applied to the workpiece so that problems of movement of the workpiece relative to the die are avoided or greatly reduced. The step of coining the workpiece between the cheek pieces and the abutment surfaces of the die produces flanged portions with a high degree of accuracy and repeatability. Where the tubular workpiece is of standard dimensions and shape, the present process allows the positioning of the workpiece accurately relative to the die to achieve a precisely dimensioned and accurately positioned flanged end on the workpiece.

The invention also provides novel apparatus particularly adapted for carrying out the above-described method. According to this aspect of the invention there is provided apparatus for forming a flanged end on a tubular workpiece comprising a die having a throat therethrough connected at one end to an abutment surface of the die extending transversely on each side of the throat, a main frame connected to the die, a sub-frame mounted reciprocably on the frame longitudinally relative to the die, a pair of chek pieces pivotally connected on the sub-frame, a wedge member mounted reciprocably on the sub-frame between the cheek pieces, means for driving the sub-frame longitudinally relative to the main frame, and means for driving the wedge member longitudinally between the cheek pieces, whereby the cheek pieces can be separated by extending the wedge member longitudinaly relative to the cheek pieces.

Figure 9:
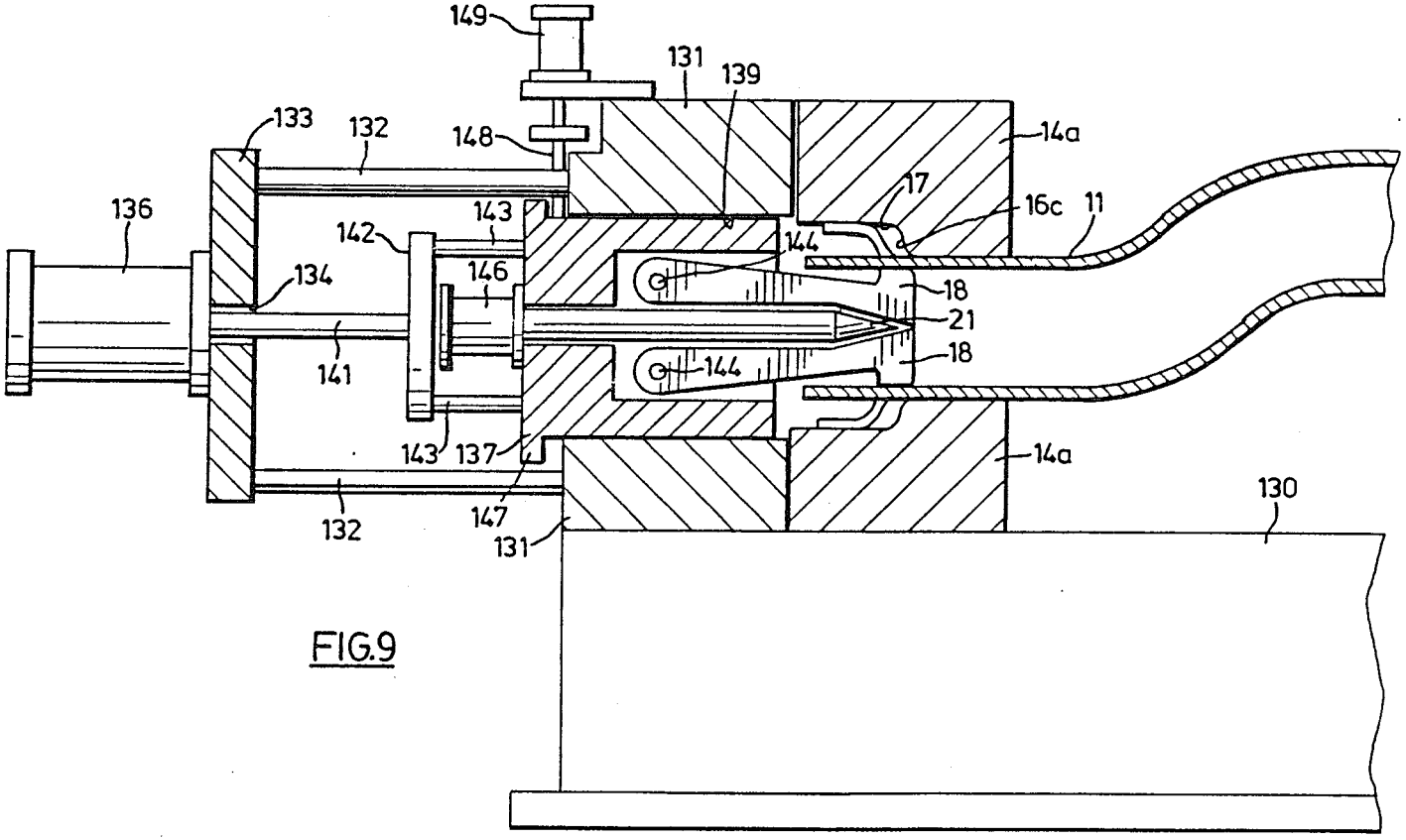

Examples of preferred forms of the present method and apparatus are described in more detail below, by way of example only, with reference to the accompanying drawings in which:

FIGS. 1*a* to 4*a* are side views illustrating partially schematically successive steps in conducting a flanging method in accordance with the invention;

FIGS. 1*b* to 4*b* are end views corresponding to FIGS. 1*a* to 4*a*, respectively, showing the tubular workpiece at successive stages of the method;

FIGS. 5*a* to 8*a* are views corresponding to FIGS. 1*a* to 4*a* and illustrating a form of the method more applicable to forming flanges of smaller transverse extent;

FIGS. 5*b* to 8*b* show, in a position corresponding to FIGS. 1*b* to 4*b*, the workpieces at successive stages of the method; and FIG. 9 is a side view, partially sectional and schematic, of apparatus particularly adapted to carry out the flanging method.

FIG. 1*a* shows a starting material tube workpiece 11 on the end of which it is desired to form flanges. Such tube 11 may be produced, for example, by the techniques described in applicant's above mentioned U.S. Pat. No. 4,576,743, and in U.S. patent application Ser. Nos. 07/046 576 filed May 6, 1987 executed Apr. 29, 1987 and 07/090,952 filed Aug. 27, 1987, executed July 2, 1987 and entitled "Method of Forming Box-like Frame Members" and "Method of Forming Reinforced Box-section Frame Members" respectively. Conveniently, the end of the tube may be formed with a relatively wide end portion 12 connecting through a portion 13 tapering in width to a remaining portion 11*a* of the tube. The tapered portion 13 can help resist axial forces transmitted to the workpiece 11 when the workpiece is received in a die 14, as shown in FIG. 2*a*, but the present method may be used with workpieces of constant cross section. The width of the cross section of the tube workpiece 11 (measured perpendicular to the plane of the paper in FIG. 1*a*) may conveniently be constant. The tube is formed to a generally rectangular cross section with rounded corners.

The tube workpiece 11 is placed within a die 14 as seen in FIG. 2. Advantageously, the die is a sectional die, preferably a two part die. FIG. 2*b* illustrates an upper section 14*a* of the die, the lower portion (not shown) being a mirror image thereof. The die 14 has a throat or opening 16 through it comprising an inner portion 16*a* of constant cross section and a portion 16*b* of tapering cross section dimensioned so that they clamp onto the portion 11a and the tapering portion 16b of the tube 11, when the die is closed and light clamping pressure is applied to maintain the two die sections in face to face contact. The use of a sectional die has the advantage that it facilitates placing, clamping and subsequent removal of the workpiece. It will be appreciated, however, that if the workpiece is of linear non-complex form and is flared and to be flanged at only one end, in such manner that the flanged end and the remainder of the tube can be withdrawn longitudinally from the die, a one piece due may be employed. Such one piece die may have for example a tapering throat so that a tapering workpiece may be introduced into the die throat, maintained stably therein by traction thereon and subsequently withdrawn from the throat after flanging.

In the example shown, the throat 16*b* connects on each side with an abutment surface 16*c* of the die extending transversely of the longitudinal axis of the throat 16 an of the workpiece 11. These abutment surfaces 16*c*, together with narrow side positions 16*d*, extending in the same plane as surfaces 16*c* along the flanks of the workpiece 11, define the bottom surface of a generally cup shaped recess 17 in the outer face of the die 14. The end side walls 17*a* of the recess are undercut and taper outwardly toward a relatively narrow opening 17*b*. The flanks 17*c* of the die recess 17 extend perpendicular to the bottom surface 16*c* and 16*d* and define between them an opening which in cross section is of width a small amount, e.g., 2 to 5%, greater than the width of the workpiece. The corners of the cavity in the die 14 are rounded, as seen in part in FIGS. 2*a* and 2*b*.

An expandable mandrel is used to perform the flanging and comprises a pair of symmetrical cheek pieces 18, the shafts of which are mounted, e.g., pivoted, on a support, not shown in FIGS. 1 to 8, so that the two pieces 18 can be urged apart. A transversely outer side of each piece 18 protrudes outwardly at 18*a* in approximate conformity to the undercut 17*a* of the die recess. The flanks 18*b* of each piece 18 (the sides parallel to the plane of the paper in FIG. 2*a*) are planar and are dimensioned so that they are a force fit in the workpiece 1 and expand the flanks 19 of the workpiece outwardly into tight conformity with the width of the opening defined between the flanks 17*c* of the die recess 17 when the mandrel is forced into the workpiece. This qualifies or forms the flank of the workpiece to a predetermined width, provides a step surface 19*a* at the base of the flanks of the workpiece, and prevents the flanks of the workpiece from tending to collapse inwards during the subsequent expansion or flange forming step. FIG. 2*b* shows the bulged or expanded flanks at an intermediate stage of expansion. When the mandrel is fitted fully into the workpiece, the flanks 19 are bulged outwardly along the entire length of the cross section of the mandrel.

Means are provided for reacting transversely between the cheek pieces 18 for forcing them apart laterally. Such means may, for example, comprise a pressure cylinder and piston arrangement acting between the pieces 18 but in the preferred form, as shown, comprises a wedge member 21 having forwardly tapering sides reacting with correspondingly inclined inner sides of each cheek piece 18 and reciprocable relative to the cheek pieces by longitudinal drive means (not shown in FIGS. 1 to 8).

As shown in FIG. 2*a*, the mandrel is inserted into the workpiece in collapsed condition, i.e,, with the member 21 in retracted position relative to the pieces 18, expanding or qualifying the flanks 19 of the workpiece outwardly until the protruding outer sides 18*a* of each cheek piece are aligned transversely with the undercuts 17*a*.

The wedge member 21 is then expanded relative to the cheek pieces 18, as seen in FIG. 3, so that the opposite ends 12*b* of the portion 12 of the workpiece are bulged outwardly into contact with the inner surfaces of the undercuts 17*a*. The workpiece, as seen in end view in FIG. 3*b*, is thereby formed with a central relatively wide bulged portion 12*b*, inner portions 12*c* which are extended transversely over the inner corners of the abutment surfaces 16*c*, and an outer portion 12*d* tapering outwardly to a relatively narrow end surface.

The cheek pieces 18 together with the wedge member 17 are then driven inwardly, to coin or stamp the transversely extending portions 12*c* of the workpiece between the forwardly facing ends of the cheek pieces 18 and the abutment surfaces 16*c*.

The coining flattens the transversely extending portions 12*c* against the abutment surfaces 16*c* and forms the workpiece with transversely extending flange portions 12*e* which are accurately dimensioned and positioned relative to the remaining portions of the workpiece 11.

The mandrel is then collapsed by withdrawing the wedge member relative to the cheek pieces 18 and withdrawing the mandrel through the narrow outer opening defined by the outer portion 12*d*.

The sectional die is opened and the formed workpiece can then be removed.

The portions of the end of the workpiece extending outwardly from the portions 19*a* and 12*e* may then be cut off to leave the workpiece with a flanged end.

In the step of forcing the mandrel into the workpiece, as illustrated in FIG. 2*a*, the flank portions of the tube sidewall are only slightly expanded and only light axial thrust is applied to the workpiece and hence only light vice clamping pressure needs to be applied by the die 4 on the tapering and main portions 13 and 11*a* of the workpiece to hold the workpiece stably in position. During the transverse expansion step shown in FIG. 3*a*, the bulging or lateral expansion is performed in a lateral balanced motion without exerting an axial thrust on the workpiece. The coining step illustrated in FIG. 4a produces an axial thrust. However, the axial force is absorbed by the inner corners of the abutment surfaces 16c and there is no slippage between the workpiece and the die 14. Hence the frictional forces exerted between the mandrel pieces 18, the workpiece 11 and the die 14 are small and only light clamping pressure is required to maintain the workpiece 11 stably within the die 14.

It will be appreciated that the above process is readily capable of accurately and repeatably forming flanged ends on standardized tubular workpieces, and can be used with relatively thin walled lightweight tubular workpieces, without requiring heavy clamping pressure or the use of lubricants.

A further advantage of the arrangement as illustrated in FIGS. 1a to 4a, wherein the workpiece is formed with a relatively long wide end portion 12, and is bulged centrally of portion 12, leaving the end 12d relative narrow, is that it can be employed to achieve a relatively large expansion of the side wall of the workpiece and hence a relative large transverse extent for the flanged surface 12e without needing to polish the edges of the starting material tube. Frequently, the starting material tube has ragged edges resulting from, for example, saw cutting, and if the edges are expanded to a large extent, the discontinuites at the edges would tend to give rise to concentrations of stress and breakage or cracking which can propagate to the region of the workpiece to be flanged. Leaving the workpiece with a relatively narrow end portion 12d reduces the stresses to which the edge of workpiece is subjected and allows relatively large expansion of workpiece without requiring pre-polishing of the edges.

FIGS. 5a to 8a illustrate a similar process which may be used where only a relatively small degree of transverse expansion is required or the edges of the workpiece are polished to avoid concentrations of stresses. Parts similar to those described above with reference to FIGS. 1a to 4a are denoted by like reference numerals raised by 100.

Hence the workpiece 111 in this case has a relatively short end portion 112 and is placed within a die 114 which has its abutment surface 116c formed on an exterior face thereof. The forming procedure is similar to that described above with reference to FIGS. 1a to 4a. The flank portions 119 of the side walls of the workpiece that are left upstanding may if desired be bent laterally outwardly to form flanges coplanar with the portions 112e and 119a instead of trimming them off.

FIG. 9 illustrates a forming machine or apparatus particularly adapted to carry out the above described processes.

The apparatus comprises a stationary bed or frame 130 on which is secured an upstanding support 131 and one half 14a of a sectional die corresponding, for example, to the die shown in FIG. 2b.

An opposite movable die half (not shown) is urged horizontally toward die half 14a by a pressure cylinder and piston arrangement or the like acting between it and the frame 130. Secured on the support 131 is an extension comprising struts 132 and an end plate 133 with an aperture 134 through it. A pressure cylinder 136 is secured on the plate 133. The pressure cylinder 136 functions to reciprocate a sub-frame member 137 longitudinally. The sub-frame member 137 reciprocates within an opening 139 in the support 132, and is connected to a piston rod 141 acting within the cylinder 136 and connected at the opposite end to a transverse plate 142 connected by struts 143 to the sub frame member 137. The cheek pieces 18 are pivoted on the sub-frame member 137 at respective pivot points 144.

A pressure cylinder 146 is connected on the sub-frame member 137 and its piston is connected to the wedge member 21.

The sub-frame member 137 has a collar 147 on which a stop member 148 engages when the stop member is in extended position, as shown in FIG. 9, to limit inward movement of sub-frame member 137. The stop member 148 is connected to a piston acting within a pressure cylinder 149 which can be operated to extend the stop member 148 or to retract it and disengage it from the collar 147.

In use, the workpiece 11 may be positioned within the throat of the sectional die 14 as seen in FIG. 9. The die 14 is arranged so that on forward movement of the sub-frame member 137 to the limiting position allowed by engagement of the collar 147 on the top member 148, the cheek pieces are aligned with the recessed portion 17 of the throat of the die 14, slightly rearwardly of the abutment surfaces 16c thereof.

The piston 141 is extended to force the cheek pieces 18 into the workpiece 11, as shown in FIG. 9, and then the piston or wedge member 21 is extended to separate the cheek pieces, expanding the side wall of the tube 11 laterally. The member 148 is then retracted and the piston 141 extended further to coin the expanded portions of the workpiece against the abutment surfaces 16c with the cheek pieces 18. The piston or wedge member 21 may then be retracted to allow inward collapse of the cheek pieces 18, and the piston 141 retracted to withdraw the sub-frame 137 together with the cheek pieces 18 and wedge member 21 from the workpiece 11. The sectional die 14 is then opened and the flanged workpiece removed. The piston or stop 148 may then be extended to the position of FIG. 9, a fresh workpiece positioned in the die 14, the die 14 closed, and then the above cycle of operations may be repeated.

I claim:

1. Method of forming a flanged end on a tubular workpiece, comprising providing a die having a throat therethrough connecting at one end with an abutment surface extending transversely on each side of the throat, disposing a tubular workpiece to extend through said throat with one end of the workpiece extending adjacent said abutment surfaces, providing a transversely expandable mandrel comprising a pair of laterally separable cheek pieces each movable to a position overlying a respective abutment surface, and means reacting between the cheek pieces to separate said cheekpieces laterally, introducing the mandrel in collapsed condition in the end of the workpiece, operating said reacting means to expand the mandrel by separating the cheek pieces and expand the side wall of the workpiece transversely outwardly to overlie said abutment surfaces, driving the cheek pieces together in the expanded condition longitudinally inwardly to coin a portion of each expanded side wall between an end face of each cheek piece and a respective abutment surface, and thereby provide a flanged portion on each side of the workpiece, withdrawing the mandrel from the workpiece, and withdrawing the flanged workpiece from the die.

2. Method as claimed in claim 1 wherein said die has a cup-shaped opening therein comprising a side wall extending between an exterior face of the die and a bottom wall constituting said abutment surfaces.

3. Method as claimed in claim 2 wherein each cheek piece has an outwardly protruding face on its laterally outer side, and the side wall of the cup-shaped opening is undercut in conformity with the protruding face, whereby the side wall of the tube is bulged laterally outwarding relative to the adjacent end of the tube when the mandrel is expanded laterally, and said die is a sectional die which can be opened to allow release of the bulged and flanged workpiece.

4. Method as claimed in claim 1 wherein the workpiece and die throat each taper inwardly from said end and from said abutment surfaces, respectively.

5. Method as claimed in claim 1 wherein said reacting means comprise a forwardly tapering wedge member reciprocable relative to the cheek pieces.

6. Method as claimed in claim 1 wherein said cheek pieces and said die comprise longitudinally extending flank surfaces parallel to the direction of separation of the cheek pieces, said flank surfaces of said cheek pieces and of said die cooperating to expand flank portions of the side wall of the workpiece a predetermined small extent outwardly on introduction of the mandrel in said collapsed condition into the end of the workpiece.

7. Apparatus for forming a flanged end on a tubular workpiece comprising a die having a throat therethrough connected at one end to an abutment surface of the die extending transversely on each side of the throat, a main frame connected to the die, a sub-frame mounted reciprocably on the frame longitudinally relative to the die, a pair of cheek pieces connected on the sub-frame and movable apart, a wedge member mounted reciprocably on the sub-frame between the cheek pieces, means for driving the sub-frame longitudinally relative to the main frame, means for driving the wedge member longitudinally between the cheek pieces, whereby the cheek pieces can be separated by extending the wedge member longitudinally relative to the cheek pieces; and a stop surface on the sub-frame, a stop member connected on the main frame and movable between positions engaging the stop surface and preventing longitudinal extension of the sub-frame relative to the main frame beyond a stop point and disengaging the stop surface to allow such movement, respectively.

8. Apparatus for forming a flanged end on a tubular workpiece comprising a die having a throat therethrough connected at one end to an abutment surface of the die extending transversely on each side of the throat, a main frame connected to the die, a sub-frame mounted reciprocably on the frame longitudinally relative to the die, a pair of cheek pieces connected on the sub-frame and movable apart, a wedge member mounted reciprocably on the sub-frame between the cheek pieces, means for driving the sub-frame longitudinally relative to the main frame, means for driving the wedge member longitudinally between the cheek pieces, whereby the cheek pieces can be separated by extending the wedge member longitudinally relative to the cheek pieces, and means for driving the separated cheek pieces longitudinally towards the abutment surface.

* * * * *